US006098874A

United States Patent [19]

Tokarski

[11] Patent Number: 6,098,874

[45] **Date of Patent: *Aug. 8, 2000**

[54] TEAR-AWAY CONTAINER TOP

[75] Inventor: Michael G. Tokarski, Dublin, Ohio

[73] Assignee: SIG Combibloc Inc., Columbus, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 09/020,440

[22] Filed: Feb. 9, 1998

[51] Int. Cl.[7] ..... B65D 5/54

[52] U.S. Cl. ..... 229/235; 229/237; 229/241; 229/242; 493/63; 493/73; 493/110

[58] Field of Search ..... 229/235, 237, 229/241, 242, 125.42, 216, 206; 493/63, 73, 110, 148, 372

[56] References Cited

U.S. PATENT DOCUMENTS

| | | | |
|---|---|---|---|
| 3,909,582 | 9/1975 | Bowen | 229/237 |
| 4,239,150 | 12/1980 | Schadowski et al. . | |
| 4,254,693 | 3/1981 | Schadowski et al. | 493/60 |
| 4,591,091 | 5/1986 | Wise | 229/206 |
| 4,655,387 | 4/1987 | Magnusson | 229/216 |
| 4,666,044 | 5/1987 | Farber | 229/237 |
| 4,703,876 | 11/1987 | Reil | 229/216 |
| 4,915,236 | 4/1990 | Kamin et al. | 229/125.42 |
| 4,915,290 | 4/1990 | Robichaud et al. | 229/125.08 |
| 4,925,034 | 5/1990 | Robichaud et al. . | |
| 4,934,590 | 6/1990 | Robichaud et al. | 229/125.09 |
| 5,101,999 | 4/1992 | Robichaud et al. | 220/258 |
| 5,188,285 | 2/1993 | Nilsson et al. | 229/242 |
| 5,306,533 | 4/1994 | Robichaud et al. | 428/34.2 |
| 5,315,923 | 5/1994 | Tokarski et al. . | |
| 5,470,016 | 11/1995 | Ljungstrom et al. | 229/237 |
| 5,639,018 | 6/1997 | Tokarski et al. | 229/125.04 |
| 5,688,463 | 11/1997 | Robichaud et al. | 264/400 |

FOREIGN PATENT DOCUMENTS

| | | | |
|---|---|---|---|
| 6600713 | 8/1966 | Netherlands | 229/242 |

*Primary Examiner*—Gary E. Elkins
*Attorney, Agent, or Firm*—Standley & Gilcrest LLP

[57] ABSTRACT

The present invention is directed to a container having a tear-away top. In general, the container comprises an outer substrate layer, an inner aseptic layer secured to the outer substrate layer, and a cut in the outer substrate layer. In order to preserve the product in the container, the cut is of a predetermined depth such that the cut does not puncture the inner aseptic layer. The cut, however, is sufficiently deep so that a predetermined portion of the top may be torn away from the container at the cut. The present invention also includes a method for manufacturing a container that has a tear-away top. The method generally includes the steps of providing an outer substrate layer, securing an inner aseptic layer to the outer substrate layer, making a cut of predetermined depth in the outer substrate layer such that the cut does not puncture the inner aseptic layer, and then forming a container. After the container has been formed, a predetermined portion of the top may be torn away from the container at the cut.

23 Claims, 9 Drawing Sheets

TEAR-AWAY CONTAINER TOP

BACKGROUND AND SUMMARY OF THE INVENTION

The present invention relates generally to food and beverage containers, and more particularly, to a tear-away top for a sealed aseptic container. Sealed aseptic containers do not support the growth of living microorganisms. As a result, sealed aseptic containers may provide a shelf life of greater than one year without the use of preservatives or refrigeration.

Sealed aseptic packages are commonly used for packaging and transporting products that are sensitive to oxygen and/or light. Accordingly, sealed aseptic packages may be used for beverages and foods such as juice, wine, gravies, and other liquid or semi-liquid foodstuffs that quickly deteriorate after exposure to oxygen or light. However, the opening facilitators of known sealed aseptic packages are designed primarily for use only with liquid foodstuffs such as juice and wine.

Known opening facilitators include caps, flip-top lids, depressable push tabs, and straw holes. While suitable for use with liquid foodstuffs, these opening facilitators may not be adapted for use with semi-liquid or viscous foodstuffs like gravy. In addition, these opening facilitators may require extraneous components that must be attached to the container by means such as adhesives. Consequently, a need exists for an opening facilitator that may be easily and efficiently used with semi-liquid and viscous foodstuffs. A need also exists for an opening facilitator that does not require extraneous components.

The present invention is designed to meet these objectives. The present invention includes a container having a tear-away top. In general, the container comprises an outer substrate layer which may include a paperboard layer, an inner aseptic layer secured to the outer substrate layer, and a cut in the outer substrate layer. In order to preserve the product in the container, the cut is of a predetermined depth such that the cut does not puncture the inner aseptic layer. The cut, however, is sufficiently deep so that a predetermined portion of the top may be torn away from the container at the cut.

The inner aseptic layer may include an oxygen barrier layer which substantially prevents the transmission of oxygen through the container. In addition, the inner aseptic layer may include a photic barrier layer which substantially controls light transmission through the container. Since the cut does not puncture the inner aseptic layer, it is preferred that the cut does not compromise the aseptic quality of the inner aseptic layer.

The cut is preferably made by a laser. The cut may have a predetermined shape such that a pouring spout is created when a predetermined portion of the top is torn away from the container. In addition, the cut may be a perforated cut or a scored cut.

The present invention also includes a method for manufacturing a container that has a tear-away top. The method generally includes the steps of providing an outer substrate layer, securing an inner aseptic layer to the outer substrate layer, making a cut of predetermined depth in the outer substrate layer such that the cut does not puncture the inner aseptic layer, and then forming a container. After the container has been formed, a predetermined portion of the top may be torn away from the container at the cut.

The present invention is primarily designed for use with semi-liquid or viscous foodstuffs such as gravies. However, the present invention may also be used in conjunction with liquid foodstuffs such as juice and wine. In addition, other objects and advantages of the present invention will be readily apparent from the following descriptions of the drawings and preferred embodiments.

DETAILED DESCRIPTION OF PREFERRED EMBODIMENT(S)

Figure 1:
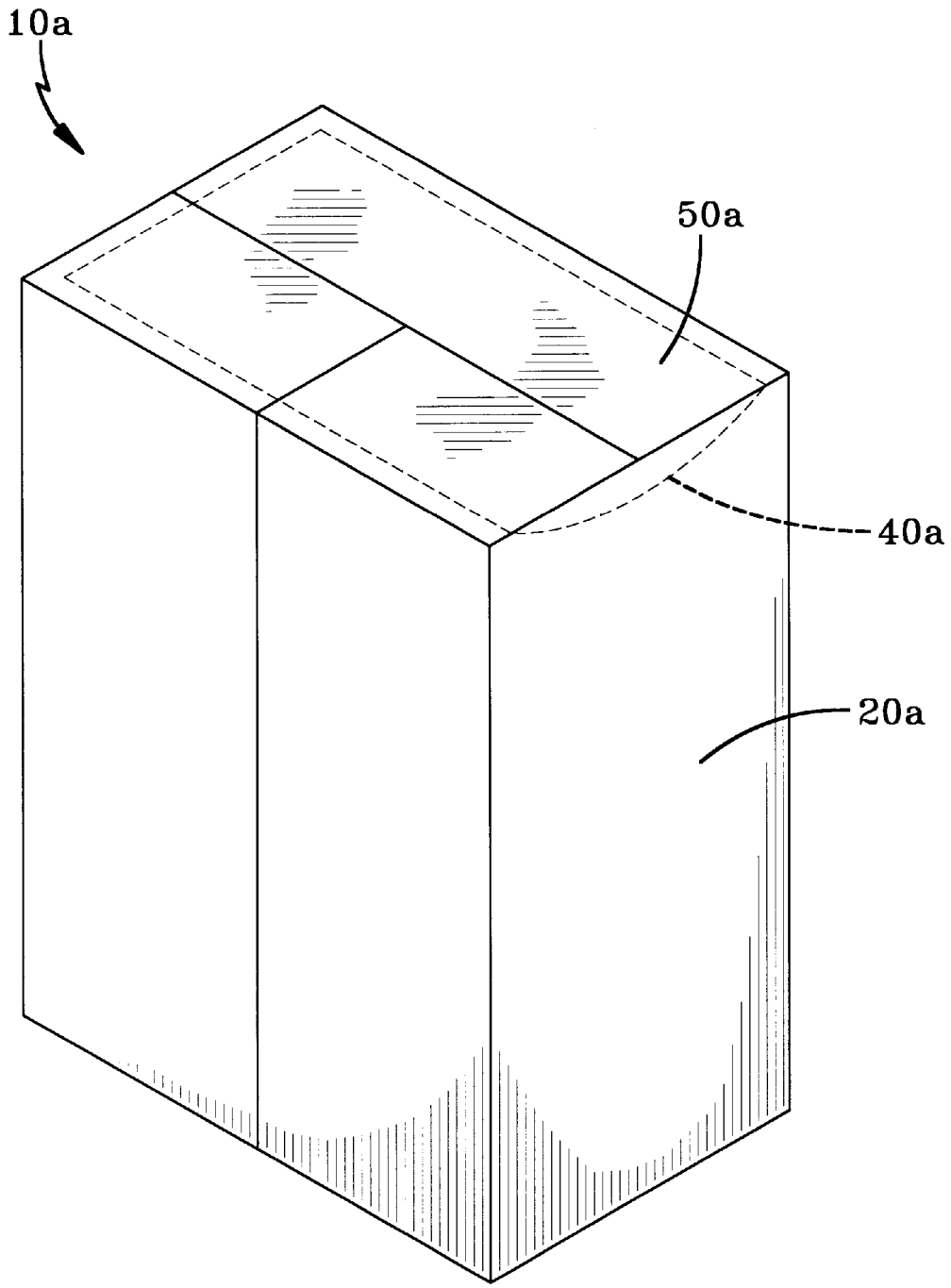
FIG. 1 is a perspective view of a preferred embodiment of the container of the present invention.

The present invention is directed to a tear-away top for a sealed aseptic container. In general, the container of the present invention includes an outer substrate layer, an inner aseptic layer, a cut, and a top. In addition, the container preferably includes other layers such as those taught by U.S. Pat. No. 5,306,533, the disclosure of which is hereby incorporated by reference. However, the other layers are not pertinent to the description of the container of the present invention. Therefore, the other layers are not described or shown in the figures.

The outer substrate layer includes a substrate such as a layer of paperboard. However, it should be recognized that other suitable substrate materials may be used in the present invention. In addition, the thickness of the substrate may vary depending on the application for the container.

The inner aseptic layer is secured to the outer substrate layer. The inner aseptic layer may include any material that impedes the deterioration of the product in the container. Since exposure to oxygen may accelerate the deterioration of the product, the inner aseptic layer preferably includes an oxygen barrier layer which substantially prevents the transmission of oxygen through the container. Similarly, a product may be sensitive to exposure to light. Accordingly, the inner aseptic layer may also include a photic barrier layer which substantially controls light transmission through the container.

The cut is of a predetermined depth in the outer substrate layer so that the cut does not puncture the inner aseptic layer. In addition, it is preferred that the cut does not compromise the aseptic quality of the inner aseptic layer. However, the cut is sufficiently deep so that a predetermined portion of the top may be torn away from the container at the cut.

The cut is preferably made by a laser. A preferred process for laser treating material is disclosed in U.S. Pat. No. 5,688,463, the disclosure of which is hereby incorporated by reference. The cut may be of any type that enables a user to tear a predetermined portion of the top off of the container. However, it is preferred that the cut is a perforated cut or a scored cut. In addition, it is preferred that the cut has a predetermined shape such that a pouring spout is created when a predetermined portion of the top is torn away from the container. The pouring spout is preferably created on one of the sides of the container.

A user may tear off a predetermined portion of the top by first severing a portion of the outer substrate layer and the inner aseptic layer at the cut. It is preferred that a user be able to sever a portion of these layers by simply depressing the container with a finger at or near the cut. Once the user severs a portion of the outer substrate layer and the inner aseptic layer at the cut, the user may then grasp the top and pull a predetermined portion of the top away from the container at the cut.

A preferred method of manufacturing the container of the present invention involves a flat card. The flat card is formed by providing an outer substrate layer and then securing an inner aseptic layer to the outer substrate layer. After the flat card is formed, a cut of predetermined depth is made in the outer substrate layer so that the cut does not puncture the inner aseptic layer. The flat card may have creases which facilitate its transition into a container. While the cut may intersect the creases, it is preferred that the path of the cut does not run directly on any of the creases.

After the cut is made in the outer substrate layer, the flat card is folded into a container. In one preferred method of folding a flat card into a container, the flat card is first formed into a sleeve. An end of the sleeve is then folded to form the bottom of the container. After the bottom of the container is formed, the interior of the container is preferably sterilized. A product which is preferably sterilized may then be deposited in the container through the open end of the sleeve.

Once the product has been deposited, the open end of the sleeve may be folded to form the top of the container. It should be noted that a predetermined amount of product should be deposited in the container so that a user does not unintentionally contact the product when tearing a predetermined portion of the top off of the container.

Figure 2:
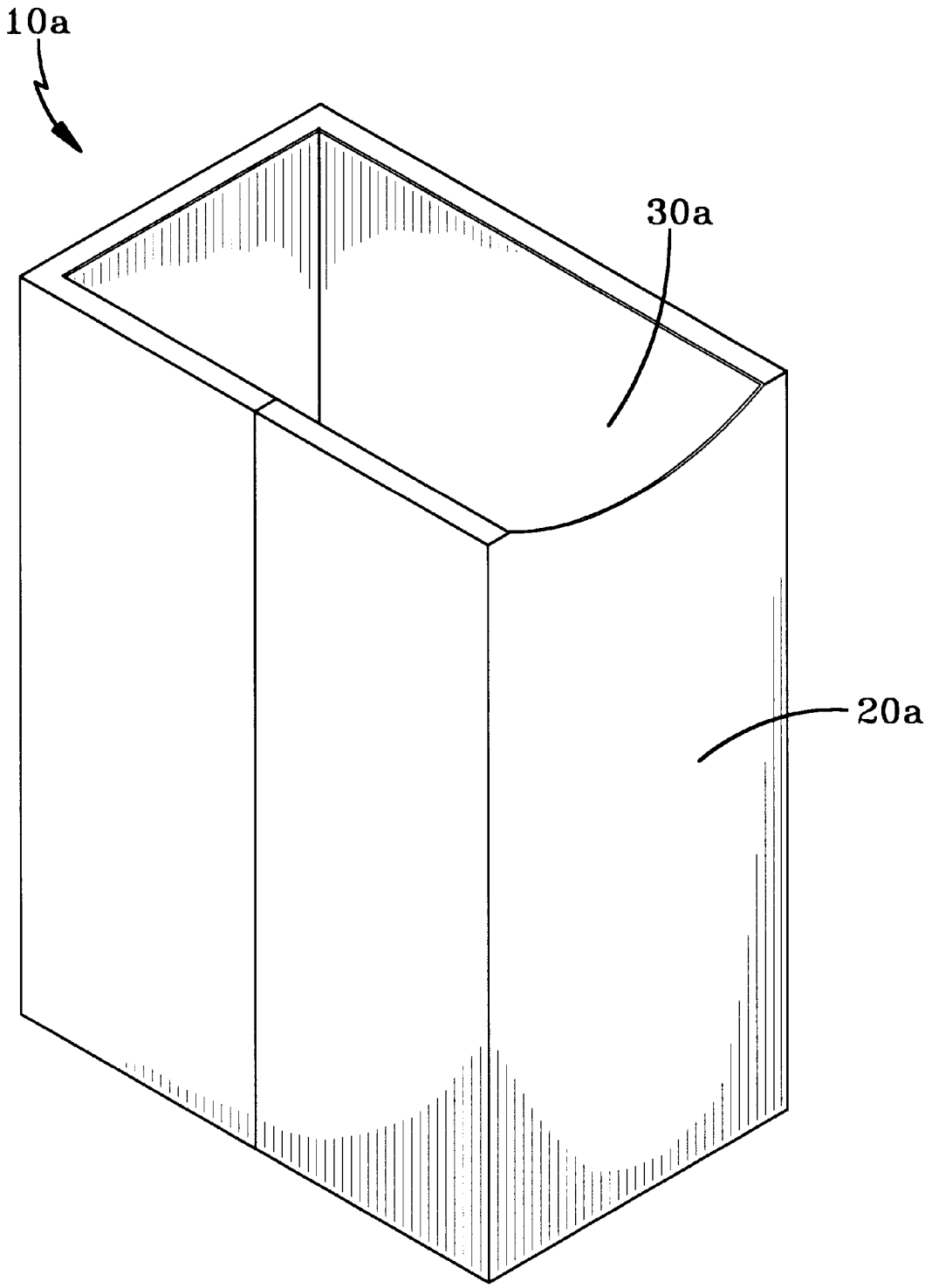
FIG. 2 is a perspective view of the container shown in FIG. 1 with the top torn off.

FIGS. 1 and 2 illustrate a preferred embodiment of the container of the present invention. The container 10*a* includes an outer substrate layer 20*a*, an inner aseptic layer 30*a*, a cut 40*a*, and a top 50*a*. FIG. 1 shows the container la with the top 50*a* still attached, whereas FIG. 2 shows the container 10*a* after a predetermined portion of top 50*a* has been torn off.

Figure 3:
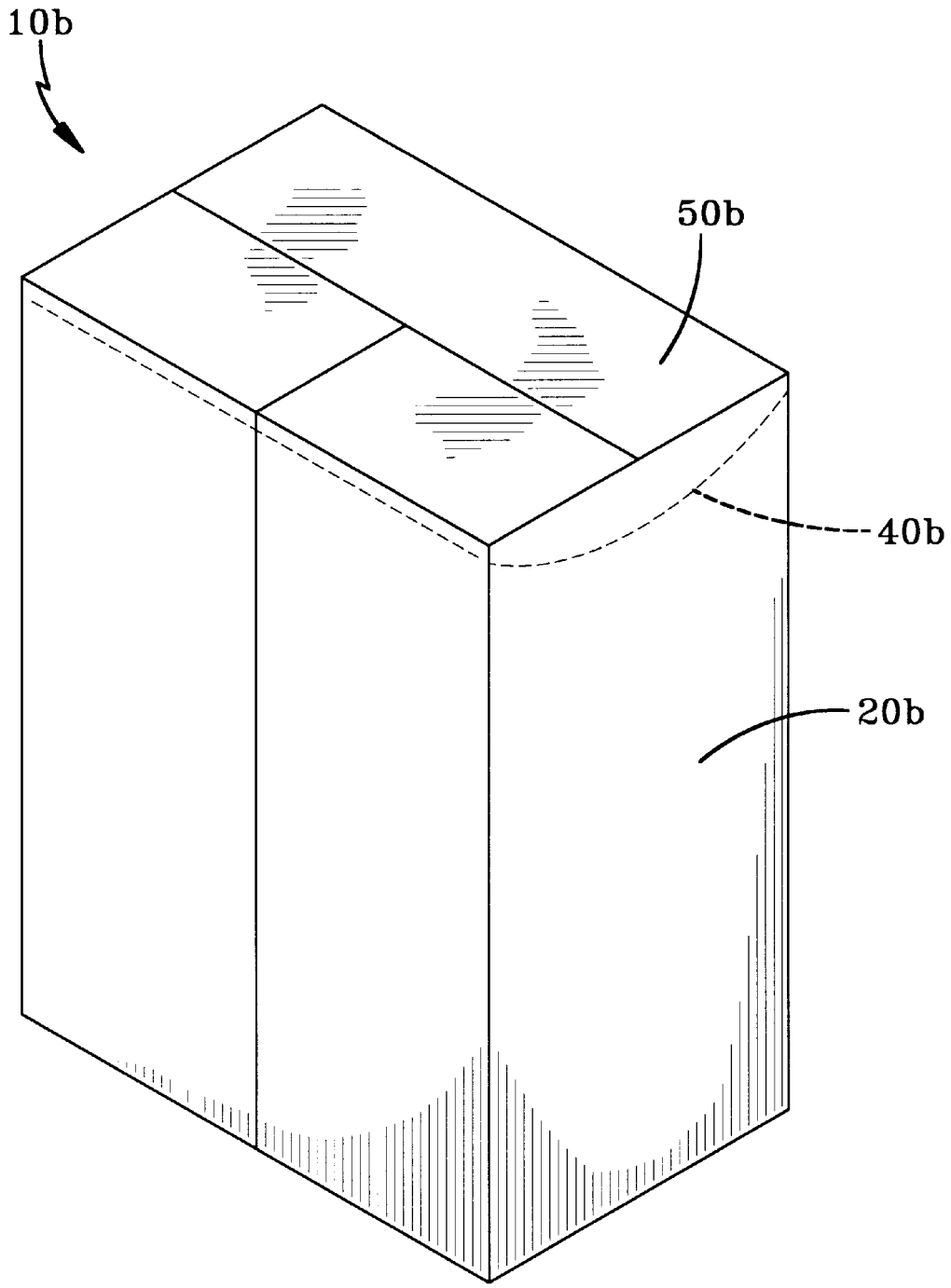
FIG. 3 is a perspective view of a preferred embodiment of the container of the present invention.
Figure 4:
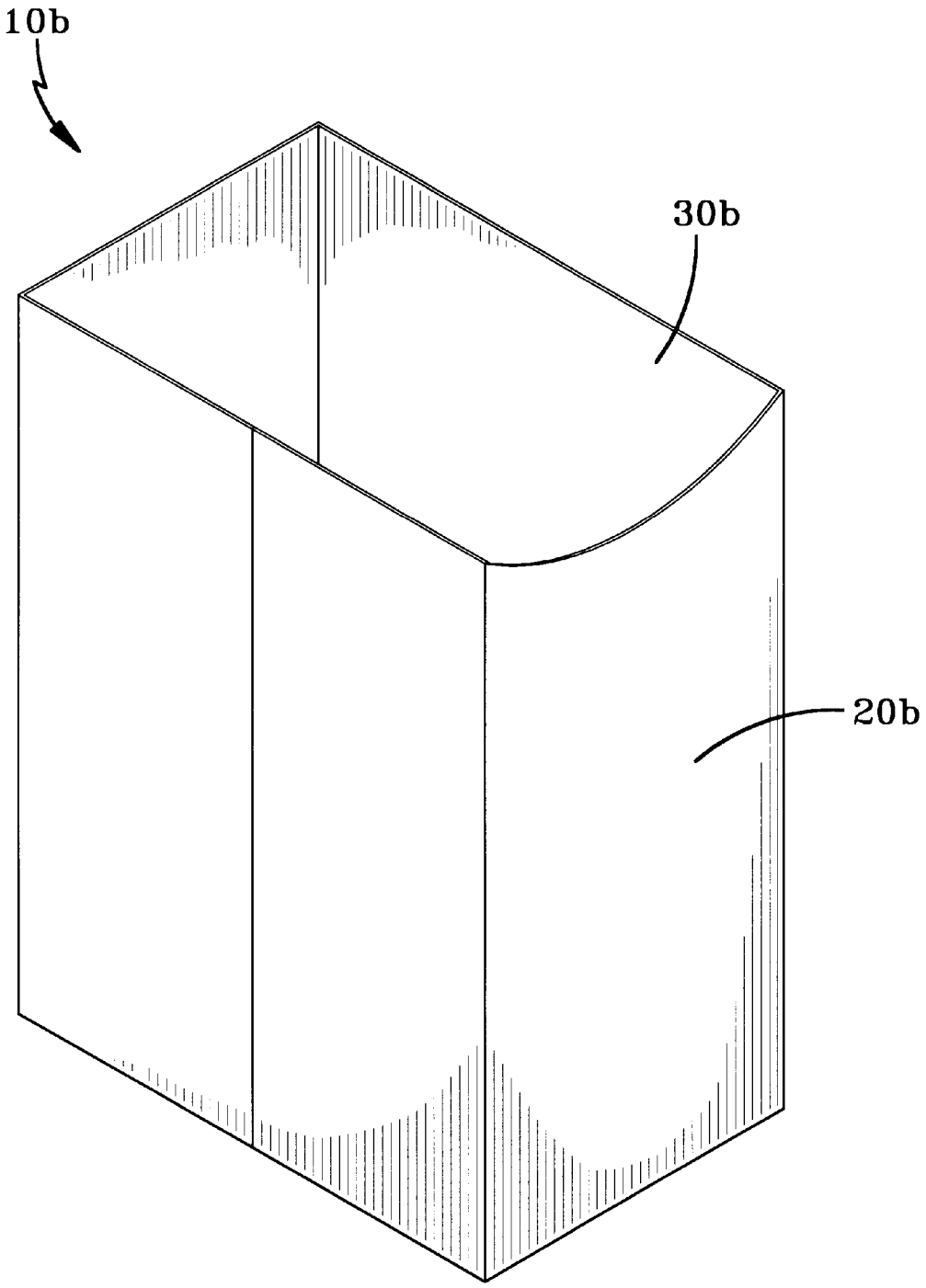
FIG. 4 is a perspective view of the container shown in FIG. 3 with the top torn off.

FIGS. 3 and 4 depict another preferred embodiment of the container of the present invention in which the path of the cut is different. The container 10*b* includes an outer substrate layer 20*b*, an inner aseptic layer 30*b*, a cut 40*b*, and a top 50*b*. FIG. 3 shows the container 10*b* with the top 50*b* still attached, whereas FIG. 4 shows the container 10*b* after a predetermined portion of the top 50*b* has been torn off.

While FIGS. 2 and 4 depict embodiments in which all or substantially all of the top has been torn off of the container, it should be recognized that a predetermined portion of the top includes any portion of the top. It should also be noted that a portion of any of the sides of the container may be torn away along with a predetermined portion of the top. For instance, the creation of a pouring spout may require that a portion of a side of the container be torn away along with a predetermined portion of the top.

Figure 5:
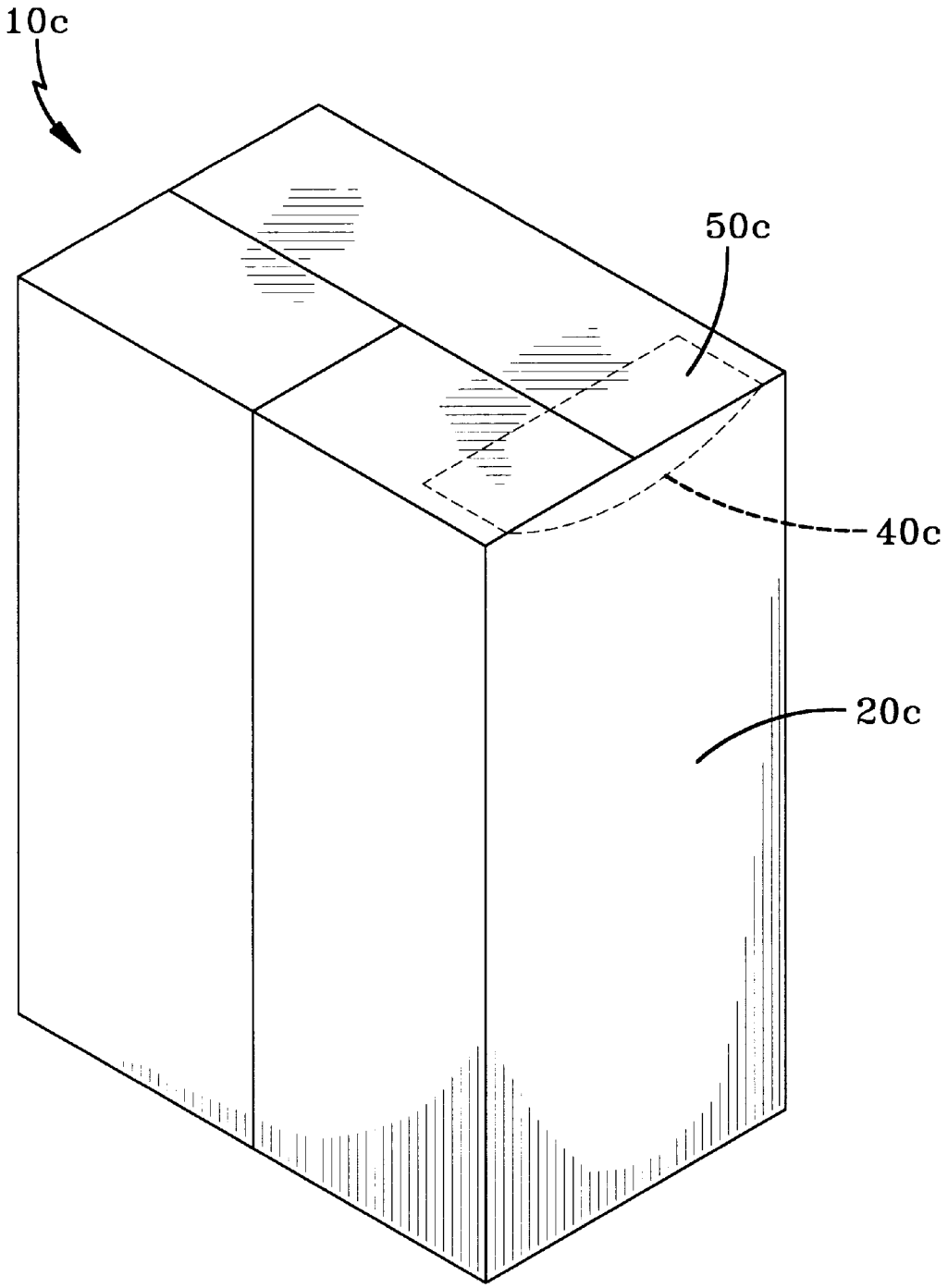
FIG. 5 is a perspective view of a preferred embodiment of the container of the present invention.
Figure 6:
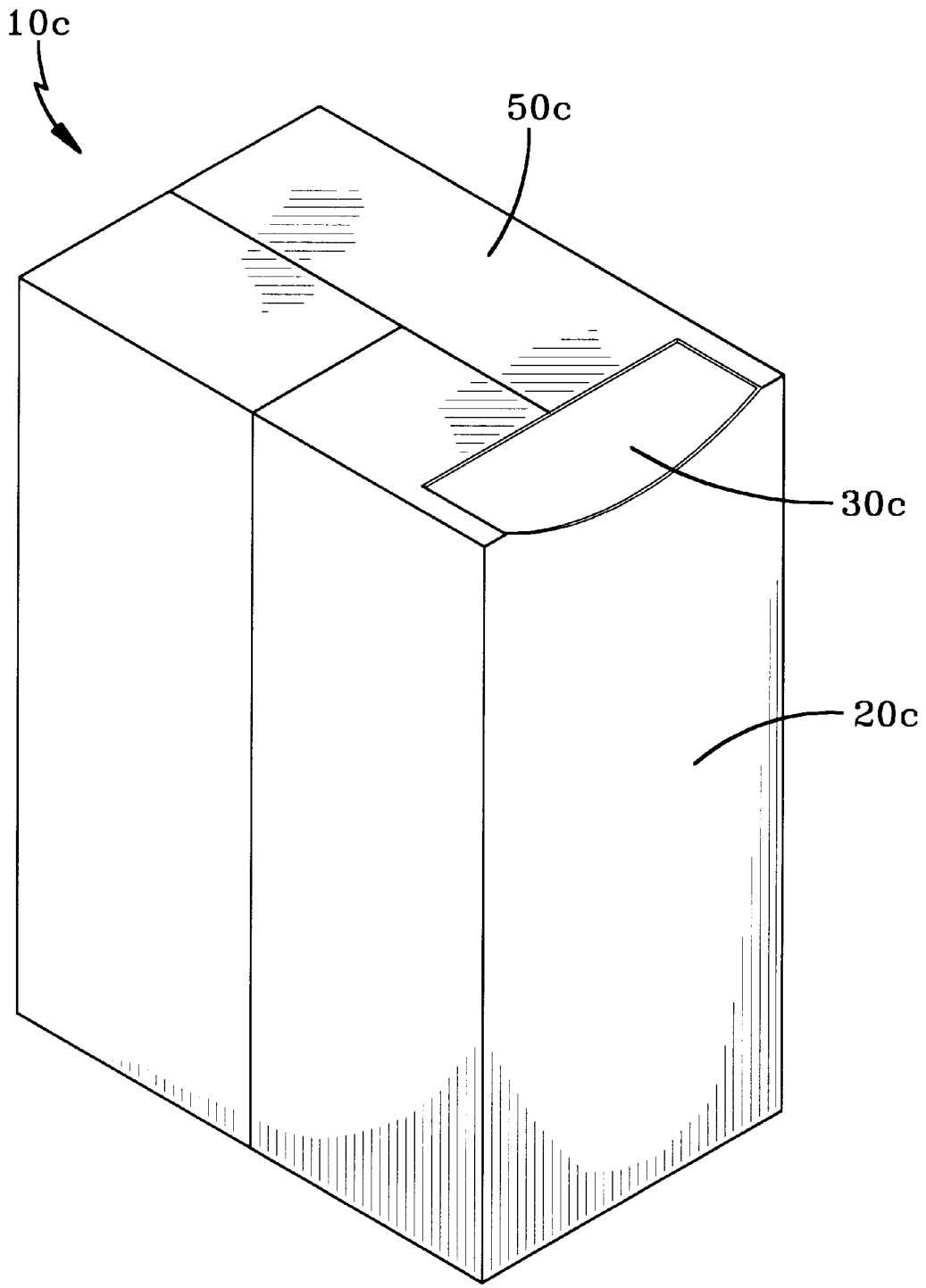
FIG. 6 is a perspective view of the container shown in FIG. 5 with a portion of the top torn off.

FIGS. 5 and 6 illustrate a preferred embodiment of the container of the present invention in which an end portion of the top may be torn away from the container at the cut. The container 10*c* includes an outer substrate layer 20*c*, an inner aseptic layer 30*c*, a cut 40*c*, and a top 50*c*. FIG. 5 shows the container 10*c* with the top 50*c* still attached, whereas FIG. 6 shows the container 10*c* after a predetermined portion of the top 50*c* has been torn off at the cut 40*c*.

Figure 7:
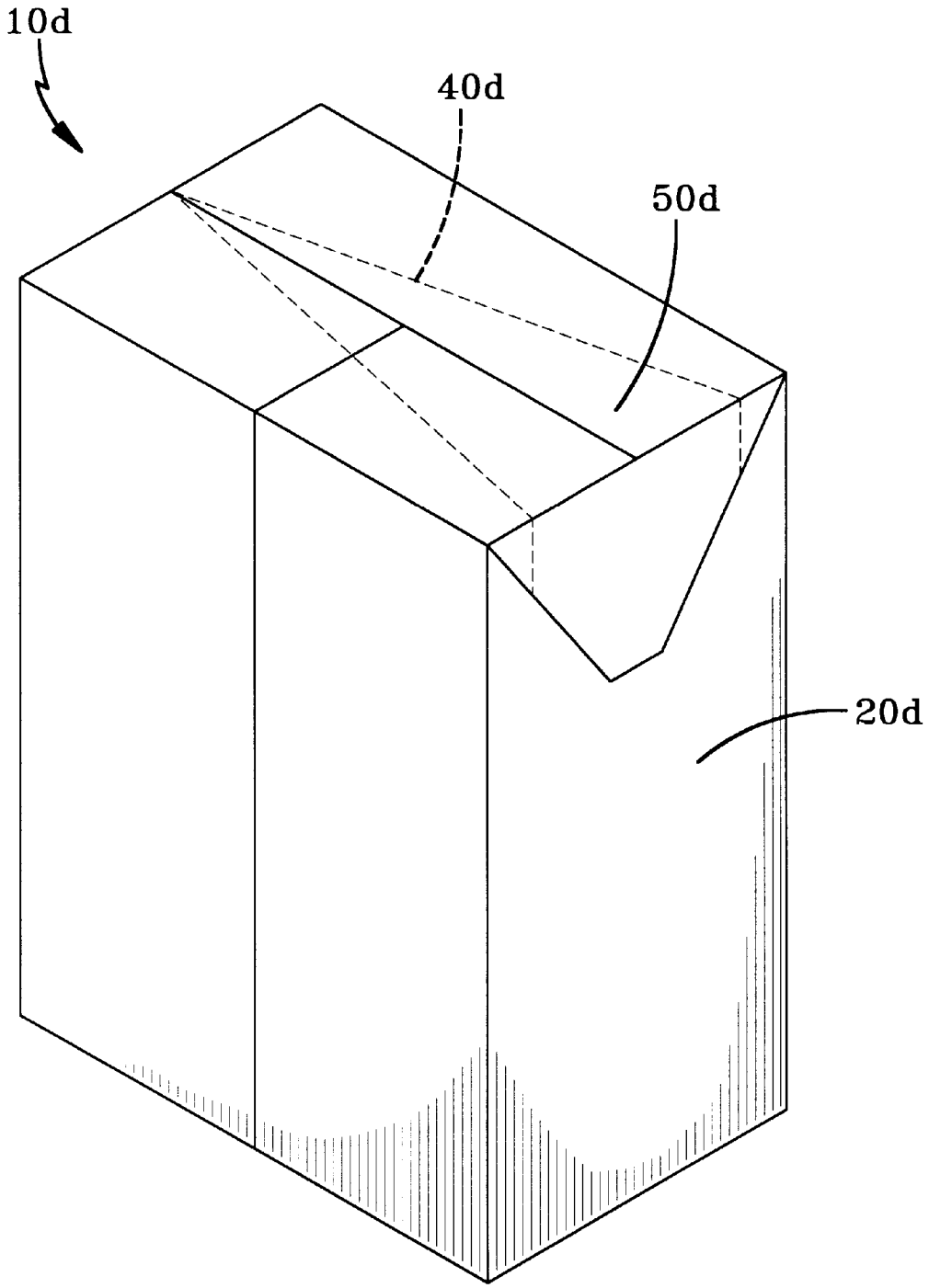
FIG. 7 is a perspective view of a preferred embodiment of the container of the present invention.

FIG. 7 shows another preferred embodiment of the container of the present invention in which a predetermined portion of the top may be torn away from the container at the cut. The container 10*d* includes an outer substrate layer 20*d*, a cut 40*d*, and a top 50*d*. It should be noted that the container 10*d* also has a flap. In this type of embodiment, at least a portion of the flap may be torn away along with a predetermined portion of the top 50*d*.

Figure 8:
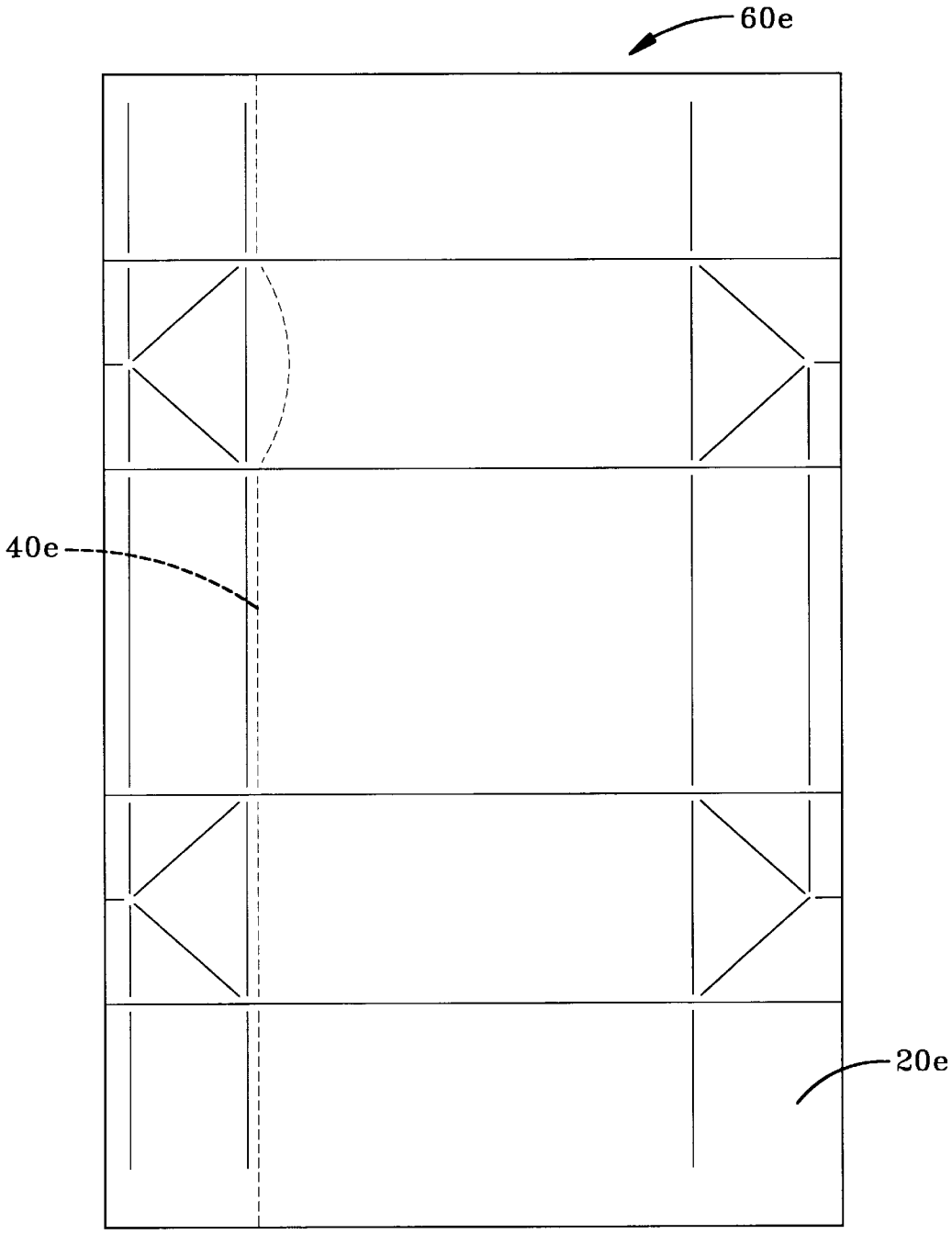
FIG. 8 is an outer plan view of a preferred embodiment of a flat card of the present invention.

FIG. 8 illustrates a preferred embodiment of a flat card 60*e* which may be folded into a preferred embodiment of the container of the present invention. As shown, the cut 40*e* is preferably made in the outer substrate layer 20*c* of the flat card 60*e*. In this embodiment, it should be noted that the cut 40*e* does not run directly on any of the creases of the flat card 60*e*.

The cut is preferably made in the flat card before the flat card is folded into the container. The cut is preferably made by a laser. The cut may be made by any laser system which may cause the local evaporation of material from the flat card. As opposed to mechanical cutting means, a laser can typically make tear lines which are more precise, which are easier to sever, and which require less force to sever. In particular, a benefit of using a laser system is that precise right angle cuts or incisions may be made without rotating the flat card. Conversely, mechanical cutting means typically can only make curved corners. Depending on the type of force applied to the predetermined portion of the top, a cut having right angles may facilitate the removal of a predetermined portion of the top.

Figure 9:
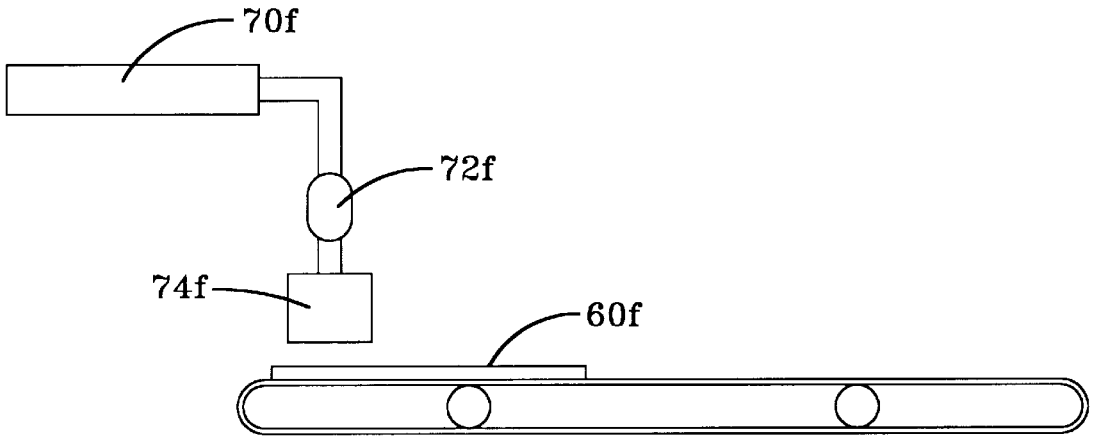
FIG. 9 is a schematic view of a preferred embodiment of a laser system which may be used to make the cut in the outer substrate layer.

FIG. 9 illustrates a preferred embodiment of a laser system which may be used to make the cut. As shown in FIG. 9, the laser 70*f* may generate a laser beam and supply it to a z-axis focus 72*f*. The laser beam may then travel through a two-axis laser galvo 74*f* which may comprise X and Y-axis positioning mirrors. The laser beam may then be guided through its desired pattern on the flat card 60*f*.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A parallelepipedic container having a top and a bottom, a first scam extending substantially across said top, a second seam extending substantially across said bottom, said container comprising:

an outer substrate layer;

an inner aseptic layer secured to said outer substrate layer; and a cut of predetermined depth in said outer substrate layer such that said cut does not puncture said inner aseptic layer;

whereby a predetermined portion of said top may be torn away from said container at said cut to form an opening through said top such that a user is enabled to pour the contents of said container through said opening; and whereby, after said predetermined portion of said top has been torn off, said container is adapted to be rested on said bottom substantially without spilling the contents of said container.

2. The container of claim 1 wherein said inner aseptic layer includes an oxygen barrier layer which substantially prevents the transmission of oxygen through said container.

3. The container of claim 1 wherein said inner aseptic layer includes a photic barrier layer which substantially controls light transmission through said container.

4. The container of claim 1 wherein said cut does not compromise the aseptic quality of said inner aseptic layer.

5. The container of claim 1 wherein said cut has a predetermined shape such that a pouring spout is created when said predetermined portion of said top is torn away from said container.

6. The container of claim 1 wherein said cut is a perforated cut.

7. The container of claim 1 wherein said cut is a scored cut.

8. The container of claim 1 wherein said cut is a laser cut.

9. The container of claim 1 wherein said outer substrate layer includes a paperboard layer.

10. The container of claim 1 wherein all of said top may be torn away from said container at said cut.

11. The container of claim 1 wherein an end portion of said top may be torn away from said container at said cut.

12. A method for manufacturing a parallelepipedic container having a top and a bottom, said top having a predetermined portion which may be torn off said container, said method comprising the steps of:

providing an outer substrate layer;

securing an inner aseptic layer to said outer substrate layer;

making a cut of predetermined depth in said outer substrate layer such that said cut does not puncture said inner aseptic layer; and forming said container such that a first seam extends substantially across said top and a second seam extends substantially across said bottom;

whereby said predetermined portion of said top may be torn away from said container at said cut to form an opening through said top such that a user is enabled to pour the contents of said container through said opening; and whereby, after said predetermined portion of said top has been torn off, said container is adapted to be rested on said bottom substantially without spilling the contents of said container.

13. The method of claim 12 wherein said inner aseptic layer includes an oxygen barrier layer which substantially prevents the transmission of oxygen through said container.

14. The method of claim 12 wherein said inner aseptic layer includes a photic barrier layer which substantially controls light transmission through said container.

15. The method of claim 12 wherein said cut does not compromise the aseptic quality of said inner aseptic layer.

16. The method of claim 12 wherein said cut has a predetermined shape such that a pouring spout is created when said predetermined portion of said top is torn away from said container.

17. The method of claim 12 wherein said cut is a perforated cut.

18. The method of claim 12 wherein said cut is a scored cut.

19. The method of claim 12 wherein said cut is made by a laser.

20. The method of claim 12 wherein said outer substrate layer includes a paperboard layer.

21. The method of claim 12 wherein all of said top may be torn away from said container at said cut.

22. The method of claim 12 wherein an end portion of said top may be torn away from said container at said cut.

23. A method for manufacturing a parallelepipedic container which holds a product, said container having a bottom and a top, said top having a predetermined portion which may be torn off said container, said method comprising the steps of:

providing an outer substrate layer;

securing an inner aseptic layer to said outer substrate layer;

making a perforated cut of predetermined depth with a laser in said outer substrate layer such that said perforated cut does not puncture said inner aseptic layer;

forming a sleeve;

forming said bottom of said container such that a first seam extends substantially across said bottom;

filling said container with a predetermined amount of said product; and forming said top of said container such that a second seam extends substantially across said top;

whereby said predetermined portion of said top may be torn away from said container at said cut to form an opening through said top such that a user is enabled to pour said product through said opening; and whereby, after said predetermined portion of said top has been torn off, said container is adapted to be rested on said bottom substantially without spilling said product.

* * * * *